US005735751A

United States Patent [19]

Pacheco

[11] Patent Number: 5,735,751

[45] Date of Patent: Apr. 7, 1998

[54] PUTTING TARGET WITH AUDIBLE FEEDBACK

[76] Inventor: Arcilio S. Pacheco, 14288 Bercaw La., San Jose, Calif. 95124

[21] Appl. No.: 815,165

[22] Filed: Mar. 11, 1997

[51] Int. Cl.[6] ..... A63B 69/36

[52] U.S. Cl. ..... 473/192; 473/186

[58] Field of Search ..... 473/173, 191, 473/192, 186, 180, 190

[56] References Cited

U.S. PATENT DOCUMENTS

| | | | |
|---|---|---|---|
| 3,972,531 | 8/1976 | Knapp | 473/192 |
| 4,006,907 | 2/1977 | Heffley, Jr. | 473/192 |
| 4,659,090 | 4/1987 | Kustanovich | 473/192 |
| 5,342,053 | 8/1994 | Smith | 473/191 |

*Primary Examiner*—Mark S. Grahm

[57] ABSTRACT

A golf putting target which includes a housing with sloped top sides and which is smaller than a regulation golf cup hole. The housing contains pressure bars, a battery, a normally open circuit and a sound synthesizer. When a putted golf ball rolls over the target a pressure bar is depressed completing a normally open circuit which causes the sound synthesizer to emit an audible sound providing feedback to a golfer.

2 Claims, 2 Drawing Sheets

PUTTING TARGET WITH AUDIBLE FEEDBACK

BACKGROUND

1. Field of Invention

This invention relates to golf putting targets, specifically to such targets which provide informational feedback to the golfer as to the accuracy of his putts.

2. Description of Prior Art

In the game of golf putting is a critical element to success. A one foot putt is worth as much as a 270 yard drive. It behooves a golfer to practice putting to improve his golf score.

Golfers can practice putting on practice greens at a golf course, or in a carpeted living room or office (on lunch hours only, of course). Savvy golfers practice putting not only toward golf holes, but also to bottles, designs in carpeting, coins, and leaves. These targets have shortcomings. Golf holes fill quickly and must be emptied. Bottles soon develop areas in front of them congested with golf balls. Designs in carpeting require that the golfer watch his putt go toward the target; this is not a desirable golf habit. Coins work well at times, but do not always provide audible feedback to the golfer; they are also extremely small targets. Leaves blow away, and they require the golfer to watch his putt. None of these methods allows the golfer to optimize his putting practice time.

Inventors have created various putting targets which do overcome some disadvantages listed above. Still, none provides an optimal combination of features and benefits which serious golfers seek.

Several putting targets and practice devices have been proposed, for example Stanton's (1984) Putting Target, U.S. Pat. No. 4,429,882, Hoyt's (1988) U.S. Pat. No. 4,725,063, Morris' (1990) U.S. Pat. No. 4,966,370, Coombs' (1990) U.S. Pat. No. 4,953,865, Lai's (1992) U.S. Pat. No. 5,139,262, Knox's (1992) U.S. Pat. No. 5,174,574, Bolanos' (1994) U.S. Pat. No. 5,306,009, and Wood's (1996) U.S. Pat. No. 5,529,304. None of these putting devices is designed for use on either carpet or practice green, and none is easily portable. None of the devices themselves provide audible feedback to the golfer.

Some putting targets are more portable than those listed above, although none of these are pocket-sized and none offer audible feedback through their features:

Ogilvie's (1990) Putting Target, U.S. Pat. No. 4,925,191, shows a target the size of a golf hole with flexible segments that allow an off-center putt to go into the hole. Although this target is portable, it must be emptied, leading to practice time and putting tempo loss. It does not provide the golfer with the means to diagnose problems with his putts, such as his tendancy to push putts right or pull them left. Manzione's (1991) Golf Cup Putting Aid, U.S. Pat. No. 5,040,799, is portable, but it, too, must be emptied. Since it is the size of a regulation golf hole, it does not improve the golfer's concentration, as a smaller target would do.

Plopper's (1993) Putting Target, U.S. Pat. No. 5,205,559, effectively reduces the size of the golf hole. The golfer, however, must empty the cup frequently, thus losing her concentration. This target must be used at a putting green on a regulation golf hole. Putting greens are frequently busy, and so the golfer's practice time with this target could be sporadic and less than optimal.

The Practice Putting and Chipping Target of Kehoe (1995) U.S. Pat. No. 5,435,560 is portable, and gives indication as to the correct speed of golfer's putt. Still, the target is regulation golf hole sized, which does not improve concentration.

OBJECTIVES AND ADVANTAGES

Accordingly, besides the objects and advantages of the putting targets described in my above patent, several objects and advantages of the present invention are:

(a) to provide a putting target which provides audible feedback to the golfer who hits the target, without the golfer's feeling the need to look at the results of the putt;

(b) to provide a putting target that is small enough to be carried in one's pocket and used on a practice green or carpet;

(c) to provide a putting target which is smaller than a regulation golf hole, to increase the focus and concentration of the golfer, (d) yet, to provide a putting target large enough to hit consistently from 3–8 feet away;

(e) to provide a putting target with sloped sides to amplify the deflection angle of the golf ball, thus showing golfer's tendency to push (right) or pull (left) putts;

(f) to provide a putting target which allows the ball to roll over it, and which gives the golfer an accurate indication of the speed of his putt.

(g) to provide golfer a means to optimize putting time through number of consecutive putts, which is also the best way to develop muscle memory;

(h) to provide golfer a means to optimize putting locations on practice green, by not limiting putting target to a preset hole;

(i) to allow golfer to putt an unlimited number of balls without having to bend down to retrieve them;

(j) to allow golfer to move target away from previously putted balls by simply sliding the target to a new location with his putter;

(k) to allow golfer to practice putts without interfering with the practice of other golfers;

DRAWINGS AND FIGURES

DESCRIPTION—FIGS. 1–5

Figure 1:
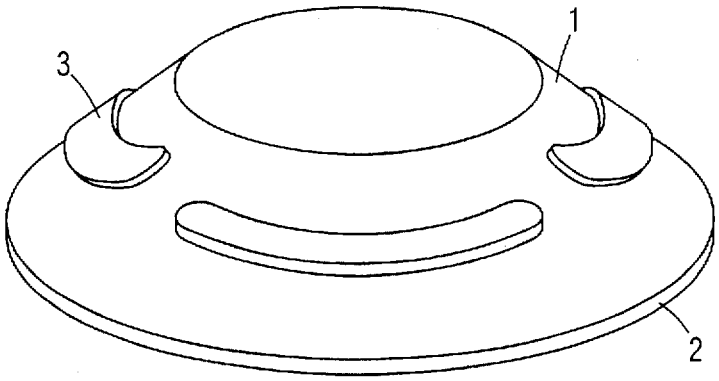
FIG. 1 shows a perspective view of the putting target.

FIG. 1 illustrates the putting target from the golfer's perspective. The top of the target (1) is a disc with a flat center and downwardly inclined sides. It can be made from a variety of materials, such as a stamped metal or a molded rigid plastic. The top (1) is perforated, allowing flexible molded pressure bars to protrude slightly above the surface of the disc. The base (2) of the putting target is a disc, preferably of a molded rigid plastic which fits onto the top (1).

Figure 2:
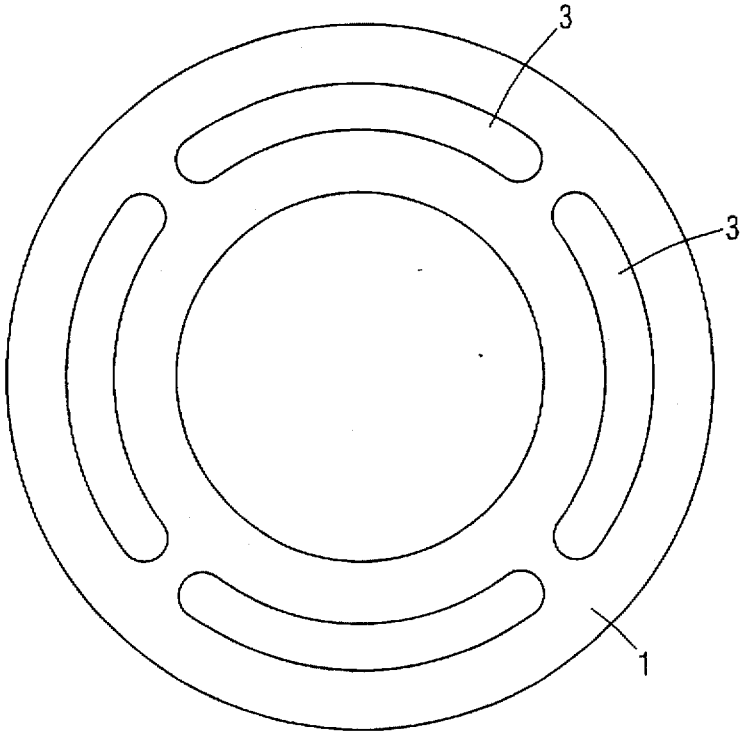
FIG. 2 shows a top view of the assembled putting target.

FIG. 2 illustrates the top (1) view of the putting target. At approximately 2⅜" in diameter, it is smaller than a regulation-sized golf hole. Four flexible, molded pressure bars (3) encircle the top of the target. These pressure bars are designed so they can be depressed when the weight of a putted golf ball passes over them.

Figure 3:
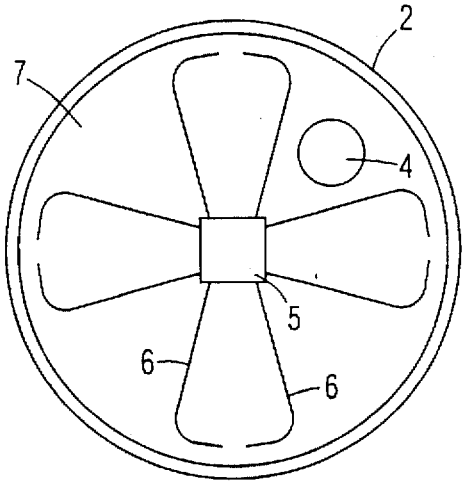
FIG. 3 shows a top view of the base and circuitry of the putting target.

FIG. 3 illustrates the top view of the inside of the putting target. The base (2) of the target holds a printed circuit board (7). The components on the printed circuit board (7) include the open circuits (6), a lithium battery (4), a battery holder (9), and a sound synthesizer (5).

Figure 4:
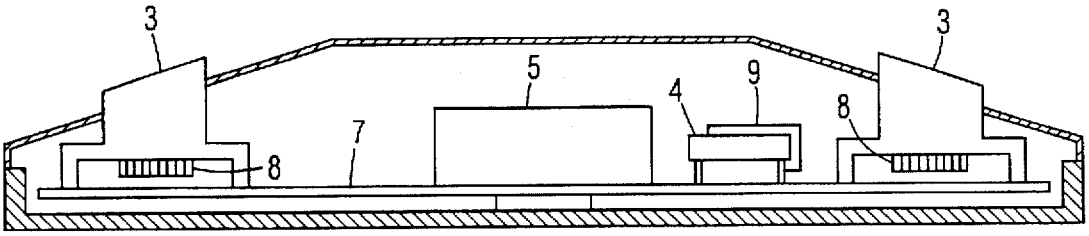
FIG. 4 shows a side elevational, cross-sectional view of the putting target.

FIG. 4 illustrates the side elevational cross-sectional view. The lithium battery (4) is housed in a battery holder (9) which is mounted on the P.C. board (7). The sound synthesizer (5) is also mounted on the P.C. board (7) The flexible molded pressure bars (3) have a strip of conductive material (8) on the underside. This conductive material (8) does not contact the P.C. board (7) when the flexible molded pressure bars (3) are not depressed.

Figure 5:
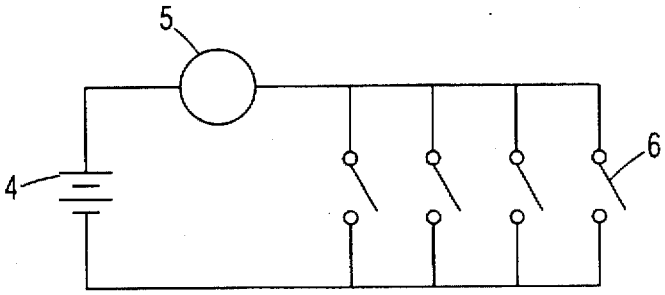
FIG. 5 shows a schematic drawing of the circuits used in the putting target.

FIG. 5 illustrates a schematic diagram of the circuits present in the golf putting target. The lithium battery (4) activates the sound synthesizer (5) when one of the open circuits (6) is closed.

OPERATION—FIGS. 1–5

Golfer places putting target on outdoor practice green or indoor carpet in a desired location. Then the golfer sets up a putt to said target. As ball rolls over target, it depresses flexible molded pressure bars (3). Said bar forces attached conductive material (8) to come into contact with open circuit (6) on the P.C. board (7). This closes the circuit, which also contains a battery (4) and sound synthesizer (5), producing an audible sound. The sound provides feedback to the golfer that the putted ball has passed over the target.

This describes a single, preferred embodiment of the present invention. It is apparent that changes to it could be made without departing from the scope of the invention.

What is claimed is:

1. A golf putting target with audible feedback comprising:

two thin discs forming a base and a cover respectively, between which is housed a printed circuit board containing a battery, circuitry, a sound synthesizer, and molded pressure bars;

said cover disc being perforated and said molded pressure bars protruding slightly through the perforations;

said molded pressure bars having conductive contacts underneath them such that when said bars are depressed a normally open electrical circuit between the battery and the synthesizer is completed, allowing the synthesizer to emit a sound;

said target comprising a low profile to allow a putted golf ball to roll over its top and thus depress the molded pressure bars to cause audible feedback to be emitted to a person putting, and allowing a ball to continue rolling past the target.

2. A golf putting target device for indicating when said target device has been struck by a putted golf ball comprising:

a base disc of a size smaller than a regulation golf hole cup;

a top disc attached to said base disc, said top disc having sloping sides which allow a golf ball to roll up an over the target;

said target device housing molded pressure bars which have conductive material affixed to an underside of said bars, a normally open circuit, and a sound means such that when one of said bars is depressed by a putted golf ball said circuit is completed which causes said sound means to emit an audible sound indicating to a golfer that a ball has passed over said target device.

* * * * *